US011486022B2

(12) United States Patent
Fujimoto et al.

(10) Patent No.: US 11,486,022 B2
(45) Date of Patent: Nov. 1, 2022

(54) FERROCOKE MANUFACTURING METHOD

(71) Applicant: JFE STEEL CORPORATION, Tokyo (JP)

(72) Inventors: Hidekazu Fujimoto, Tokyo (JP); Takashi Anyashiki, Tokyo (JP); Toru Shiozawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 15/548,900

(22) PCT Filed: Feb. 1, 2016

(86) PCT No.: PCT/JP2016/052875
§ 371 (c)(1),
(2) Date: Aug. 4, 2017

(87) PCT Pub. No.: WO2016/125727
PCT Pub. Date: Aug. 11, 2016

(65) Prior Publication Data

US 2018/0023166 A1 Jan. 25, 2018

(30) Foreign Application Priority Data

Feb. 6, 2015 (JP) ..... JP2015-021695

(51) Int. Cl.
*C21B 5/00* (2006.01)
*C22B 1/242* (2006.01)
(Continued)

(52) U.S. Cl.
CPC ..... *C22B 1/242* (2013.01); *C10B 1/04* (2013.01); *C10B 31/02* (2013.01); *C10B 45/00* (2013.01);
(Continued)

(58) Field of Classification Search
CPC ..... C21B 5/007; C21B 5/008
See application file for complete search history.

(56) References Cited

U.S. PATENT DOCUMENTS 4,318,779 A * 3/1982 Tsuyuguchi ..... C10B 57/04 201/23
2011/0016778 A1 1/2011 Musokhranov
2012/0144734 A1* 6/2012 Fujimoto ..... C22B 1/245 44/504

FOREIGN PATENT DOCUMENTS

CN 102083942 A 6/2011
CN 102159670 A 8/2011
(Continued)

OTHER PUBLICATIONS

Machine translation of JP-2008056791-A (Year: 2008).*
(Continued)

*Primary Examiner* — Ellen M McAvoy
*Assistant Examiner* — Ming Cheung Po
(74) *Attorney, Agent, or Firm* — RatnerPrestia

(57) ABSTRACT

In a ferrocoke manufacturing method by shaping and carbonizing a mixture of coal and iron ore, a hardly softening coal having a button index (CSN) of not more than 2.0 is used as the coal. The coal can be a blend of hardly softening coal and easily softening coal, and the hardly softening coal can be a coal having a button index (CSN) of 1.0 and a volatile matter of not less than 17%, and the easily softening coal can be a coal satisfying that a value obtained by multiplying CSN of easily softening coal by a blending ratio of easily softening coal in all coals is a range of 0.3-5.2. The coal can also be a blend of hardly softening coal and easily softening coal, and the hardly softening coal can be a coal having a button index (CSN) of 1.5-2.0, and the easily softening coal can be a coal satisfying that a value obtained
(Continued)

CSN of blending ratio of easily softening coal * Blending ratio of easily softening coal(-)

by multiplying CSN of easily softening coal by a blending ratio of easily softening coal in all coals is nit more than 5.0.

5 Claims, 7 Drawing Sheets

(51) Int. Cl.

| | |
|---|---|
| ***C10B 53/08*** | (2006.01) |
| ***C21B 13/00*** | (2006.01) |
| ***C10B 1/04*** | (2006.01) |
| ***C10B 31/02*** | (2006.01) |
| ***C10B 45/00*** | (2006.01) |
| ***C10B 57/06*** | (2006.01) |
| ***C10L 5/04*** | (2006.01) |
| ***C10L 5/06*** | (2006.01) |

(52) U.S. Cl.
CPC ..... *C10B 53/08* (2013.01); *C10B 57/06* (2013.01); *C10L 5/04* (2013.01); *C10L 5/06* (2013.01); *C21B 5/007* (2013.01); *C21B 13/0066* (2013.01); *C10L 2200/024* (2013.01); *C10L 2290/30* (2013.01)

(56) References Cited

FOREIGN PATENT DOCUMENTS

| | | | | | |
|---|---|---|---|---|---|
| EP | 2937407 | A1 | * | 10/2015 | ..... C21B 13/002 |
| JP | 5220481 | B2 | | 6/1977 | |
| JP | S5423604 | A | | 2/1979 | |
| JP | S5480302 | A | | 6/1979 | |
| JP | 5780481 | A | | 5/1982 | |
| JP | 598313 | B2 | | 2/1984 | |
| JP | 6245914 | B2 | | 9/1987 | |
| JP | 63137989 | A | | 6/1988 | |
| JP | 2004217914 | A | | 8/2004 | |
| JP | 2005053982 | A | | 3/2005 | |
| JP | 2007126505 | A | | 5/2007 | |
| JP | 2008056791 | A | | 3/2008 | |
| JP | 2008056791 | A | * | 3/2008 | |
| JP | 2009227781 | A | * | 10/2009 | |
| JP | 2011037963 | A | | 2/2011 | |
| JP | 2011046932 | A | | 3/2011 | |
| JP | 4892929 | B2 | | 3/2012 | |
| JP | 4892930 | B2 | | 3/2012 | |
| JP | 5017969 | B2 | | 9/2012 | |
| KR | 20140130458 | A | | 11/2014 | |
| WO | WO-2014098413 | A1 | * | 6/2014 | ..... C21B 13/002 |

OTHER PUBLICATIONS

Machine Translation of Fujimoto (Year: 2008).*
Machine Translation of JP 2008056791 (Year: 2008).*
Machine Translation of JP 2009227781A (Year: 2009).*
Database WPI, Week 197913, Thomson Scientific, London, GB; AN 1979-24763B, XP002776763, Feb. 22, 1979, 1 page.
Database WPI, Week 197932, Thomson Scientific, London, GB; AN 1979-58726B, XP002776764, Jun. 27, 1979, 1 page.
Extended European Search Report for European Application No. 16746558.2, dated Jan. 3, 2018, 9 pages.
Japanese Office Action for Japanese Application No. 2017-149902, dated Sep. 19, 2018, with Concise Statement of Relevance of Office Action, 4 pages.
Notification of Reasons for Refusal for Korean Application No. 10-2017-7021736, dated Jun. 8, 2018 with translation, 10 pages.
Chinese Office Action for Chinese Application No. 201680007312.2, dated Jun. 3, 2019 with Search Report, 8 pages.
International Search Report and Written Opinion for International Application No. PCT/JP2016/052875, dated Mar. 15, 2016—5 Pages.
Japanese Office Action for Japanese Application No. JP2016-538825, dated Jun. 6, 2016, with Concise Statement of Relevance of Office Action. 3 pages.

* cited by examiner

CSN of blending ratio of easily softening coal * Blending ratio of easily softening coal(-)

FERROCOKE MANUFACTURING METHOD

CROSS REFERENCE TO RELATED APPLICATIONS

This is the U.S. National Phase application of PCT/JP2016/052875, filed Feb. 1, 2016, and claims priority to Japanese Patent Application No. 2015-021695, filed Feb. 6, 2015, the disclosures of each of these applications being incorporated herein by reference in their entireties for all purposes.

FIELD OF THE INVENTION

This invention relates to a ferrocoke manufacturing method by carbonizing a mixture of coal and iron ore.

BACKGROUND OF THE INVENTION

Recently, the operation of a blast furnace is strongly demanded to improve reduction reaction in the furnace from a viewpoint of consideration to the global environment. In this connection, attention is paid to the use of ferrocoke obtained by shaping and carbonizing a mixture of coal and iron ore.

The ferrocoke is usually manufactured by using an easily softening coal (caking coal, strong caking coal) indicating a softening and melting property during carbonization of coal and/or a hardly softening coal (non-slightly caking coal, non-caking coal) suppressing fusion between mutual shaped bodies. The hardly softening coal has a maximum fluidity of less than 2 ddpm measured by Gieseler plastometer described in JIS M8801. On the other hand, it is important that ferrocoke has an excellent reactivity, but it is required to have a certain strength because deterioration of gas permeability in the blast furnace is caused if it is easily powdered in the blast furnace. In general, a blending ratio of coal to iron ore is frequently made to about 7:3. When the ratio of iron ore is lower than the above value, the reactivity of ferrocoke tends to be decreased, while when it exceeds the above value, the improvement of the reactivity is small and the strength of ferrocoke tends to be largely decreased. As to the strength, a target drum strength of ferrocoke (150 revolutions, 6 mm index) is defined to be not less than 82 in "Research on innovative iron-making process" performed since 2006 by the New Energy and Industrial Technology Development Organization, for example.

As an example of ferrocoke, Patent Document 1 discloses a method wherein semi-anthracite having a volatile matter of not more than 18 mass % and/or anthracite are/is blended to perform size control for suppressing fusion of the ferrocoke and maintaining strength. Also, Patent Document 2 discloses that a blending ratio of non-caking coal is defined based on a ratio of Fe to O in iron ore in the blending of hardly softening coal (non-caking coal or coal having no caking property described in Patent Document 2). Further, Patent Document 3 discloses that iron sand is used as an iron source and a blending ratio of non-caking coal is determined in accordance with a blending ratio of the iron sand. In the ferrocoke disclosed in these documents, a substance having no caking property or a maximum fluidity of 0 ddpm such as non-caking coal, lignite, anthracite, petroleum coke, coal or the like is used as a raw material.

Thus, the conventional ferrocoke mainly uses coal having no caking property (substance having a maximum fluidity of 0 ddpm such as non-caking coal, lignite, anthracite, petroleum coke, coal) as a raw material. However, coal indicating slight swelling by an evaluation of button index (hereinafter abbreviated as "CSN") described in JIS M8801 exists in the coals having a maximum fluidity (hereinafter abbreviated as "MF") of 0 ddpm, so that it is considered that coke further increasing the strength of the ferrocoke is existent in the coals having MF of 0 ddpm. Moreover, CSN means an index of discrete value such as 1, 1.5, 2, . . . 9 fitted when a test sample is placed in an exclusive crucible and rapidly heated at 820° C. and a form of a coke cake after resolidification is compared to a standard profile diagram. As the index value becomes smaller, the caking property becomes poorer.

As regards the button index (CSN), there is a technique disclosed, for example, in Patent Document 4 as a conventional technique for the manufacture of shaped coke instead of the ferrocoke. In the examples of this document is described a case of blending an inferior quality coal having CSN of 0.5. In Patent Documents 5 and 6 is described a case of blending a non-caking coal or a fine caking coal having CSN of 0-1. In Patent Document 7 is described a case of blending a non-caking coal or a fine caking coal having CSN of 0-1 and a fine caking coal having CSN of 1.5. In the case of blending the fine caking coal having CSN of 1.5, the strength of the shaped coke is low.

All the raw material for the shaped coke is usually constructed with carbon material. In the case of ferrocoke containing an iron ore of different characteristics from coal, however, the iron ore has no effect of the improvement of ferrocoke, so that it is considered that it is preferable to use coal having MF of more than 0 ddpm and CSN of not less than 0 as a carbon material. As to the blending of raw materials for ferrocoke, the blending ratio has hitherto been described as in Patent Documents 2 and 3, but it is actual that there is no finding on the examination of the nature (MF, CSN).

PATENT DOCUMENTS

Patent Document 1: Japanese Patent No. 5017969
Patent Document 2: Japanese Patent No. 4892929
Patent Document 3: Japanese Patent No. 4892930
Patent Document 4: JP-A-S57-80481
Patent Document 5: JP-B-S62-45914
Patent Document 6: JP-B-S59-8313
Patent Document 7: JP-B-S52-20481

SUMMARY OF THE INVENTION

Ferrocoke is usually manufactured by carbonizing a shaped body of a mixture of a carbon material such as coal and an iron ore as an iron source in an exclusive shaft furnace. Also, the ferrocoke is required to have a high reactivity and a high strength. In order to obtain the high reactivity of the ferrocoke, it is considered to increase blending of an iron ore or an easily softening coal having a low carbon content. However, the increase of blending the iron ore is apt to bring about the decrease of ferrocoke strength, so that it is considered that the use of the easily softening coal having a low carbon content is more preferable because the decrease of the strength becomes smaller. On the other hand, since the easily softening coal having a low carbon content is high in the volatile matter, there is a risk of increasing the porosity of ferrocoke, so that there is a problem that the fear of causing the decrease of the strength is high as compared to coal having a high carbon content.

In order to solve the above problem, it is necessary to use a coal improving the ferrocoke strength as a hardly softening coal blended for the purpose of suppressing the fusion between the mutual shaped bodies in the shaft type carbonization furnace. In general, it is known that the fusion between the mutual shaped bodies is easily caused when a large amount of an easily swelling coal or a coal having a small shrinking quantity is blended. In order to increase the ferrocoke strength, therefore, it is necessary to selectively use a coal swelling to a certain level and being small in the shrinking quantity, so that the selection of a hardly softening coal is important like that of the easily softening coal.

It is an object of the invention to propose a method effective for manufacturing high-strength ferrocoke without causing the fusion between the mutual shaped bodies.

The inventors have made various studies on the aforementioned problems inherent to the conventional techniques and found that the ferrocoke strength can be increased by setting the button index of the hardly softening coal as a raw coal material for the manufacture of ferrocoke to a preferable range without causing the fusion between the mutual shaped bodies, and as a result the invention has been accomplished. Furthermore, it has been found that similar results can be obtained by properly adjusting the nature and blending amount of the easily softening coal in accordance with the nature of the hardly softening coal, and it becomes possible to select the raw materials within a wider range.

That is, the invention includes a ferrocoke manufacturing method by shaping and carbonizing a mixture of coal and iron ore, characterized in that a hardly softening coal having a button index (CSN) of not more than 2.0 is used as the coal.

In the ferrocoke manufacturing method according to the invention, the followings are considered to be preferable solution means:

(1) a hardly softening coal having a button index (CSN) of 1.5-2.0 is used as the coal;

(2) the coal is a blend of a hardly softening coal and an easily softening coal, and the hardly softening coal has a button index (CSN) of 1.0 and a volatile matter of not less than 17%, and the easily softening coal satisfies that a value obtained by multiplying CSN of the easily softening coal by a blending ratio thereof in all coals is in a range of 0.3-5.2;

(3) the blending ratio of the easily softening coal in all coals is not more than 0.8; and (4) the coal is a blend of the hardly softening coal and the easily softening coal, and the hardly softening coal is a coal having a button index (CSN) of 1.5-2.0, and the easily softening coal satisfies that a value obtained by multiplying CSN of the easily softening coal by a blending ratio thereof in all coals is not more than 5.0.

According to the invention having the aforementioned construction, ferrocoke having a required strength can be manufactured even when only the hardly softening coal is used, and also it is possible to select coals within a wider range by selecting the easily softening coal in accordance with the nature of the hardly softening coal, and it is possible to manufacture ferrocoke having a higher strength even when a coal having a low carbon content and being low in the cost is used as the easily softening coal. Also, when a coal having a low carbon content can be used by applying the invention, ferrocoke having a higher reactivity can be obtained, which largely contributes to the operation of the blast furnace at a low reducing material ratio.

DETAILED DESCRIPTION OF EMBODIMENTS OF THE INVENTION

Figure 1:
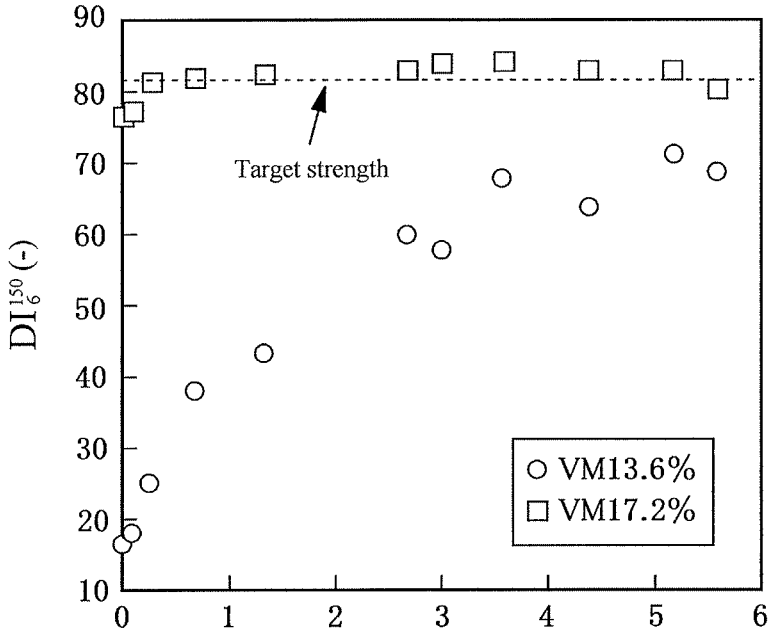
FIG. 1 is a graph showing a relation between CSN of an easily softening coal and a blending ratio of an easily softening coal exerting a strength after carbonization in the case of using a hardly softening coal with a button index (CSN) of 1.0.

The invention includes a ferrocoke manufacturing method having a high strength and a high reactivity without causing the decrease of the strength even if an inferior quality coal is used. That is, this method is characterized in that when a mixture of coal and iron ore is shaped and carbonized to manufacture ferrocoke, a coal having a button index (CSN) of not more than 2.0 is used as a hardly softening coal. The reason why the button index (CSN) of the hardly softening coal is limited to not more than 2.0 is due to the fact that when a coal having a CSN value of more than 2.0 is used, if a shaped body of this hardly softening coal and an iron ore (a weight ratio of the iron ore in the mixture of the hardly softening coal and the iron ore is 30 mass %) is carbonized, fusion between the mutual shaped bodies is generated inevitably and hence the effect of suppressing the fusion by the addition of the hardly softening coal cannot be obtained.

The lower limit of the button index (CSN) of the hardly softening coal is not particularly limited. However, when the button index (CSN) of the hardly softening coal is 1.0, a target strength may not be attained in accordance with a volatile matter of the hardly softening coal as seen from examples mentioned later, so that the button index (CSN) of the hardly softening coal is preferable to be 1.5-2.0.

In examples according to the invention that the coal is a blend of hardly softening coal and easily softening coal and the hardly softening coal is a coal having a button index (CSN) of 1.5-2.0, it is preferable that the easily softening coal satisfies that a value obtained by multiplying CSN of the easily softening coal by a blending ratio thereof in all coals is not more than 5.0. Furthermore, in examples according to the invention that the coal is a blend of hardly softening coal and easily softening coal and the hardly softening coal is a coal having a button index (CSN) of 1.0, it is preferable that the hardly softening coal is a coal having a volatile matter of not less than 17% and the easily softening coal satisfies that a value obtained by multiplying CSN of the easily softening coal by a blending ratio thereof in all coals is within a range of 0.3-5.2. Moreover, the volatile matter is measured according to JIS M8812 and represented by dry ash free base.

EXAMPLES

There will be described preferable examples using a blend of a hardly softening coal and an easily softening coal below.

This experiment is performed according to the following process. A shaped body is manufactured by changing each CSN of a hardly softening coal and an easily softening coal (carbon content and MF are varied with the change of CSN) to evaluate strength after carbonization (ferrocoke strength). The hardly softening coal and the easily softening coal are blended so as to render coals of plural brands into predetermined CSN and carbon content. As a quality of the coal used, Table 1 shows a grade of the easily softening coal and Table 2 shows a grade of the hardly softening coal. As an iron ore are used ones having a total iron content of 57 mass %. A pulverized grain size of each of the coal and iron ore is not more than 3 mm in total. Also, a maximum fluidity MF in Table 2 is measured by a Gieseler plastometer. A sensitivity is low at a lower range of MF. In this time, MF measurement of the hardly softening coal is performed five times, and an average value thereof is determined as MF value.

TABLE 1

| Brand | CSN (-) | MF (ddpm) | Ash content (%) |
|---|---|---|---|
| A | 2.5 | 30 | 21.5 |
| B | 3.0 | 4 | 9.7 |
| C | 3.5 | 2 | 18.1 |
| D | 4.5 | 33 | 8.8 |
| E | 5.0 | 29 | 8.0 |
| F | 5.5 | 82 | 7.8 |
| G | 6.0 | 81 | 8.9 |
| H | 6.5 | 85 | 7.3 |
| I | 7.0 | 2 | 8.8 |

TABLE 2

| Brand | MF (ddpm) | CSN (-) | VM (%) | Ash content (%) |
|---|---|---|---|---|
| J | 0.00 | 1.0 | 12.5 | 12.7 |
| K | 0.00 | 1.0 | 14.6 | 10.8 |
| L | 0.60 | 1.0 | 17.2 | 10.9 |
| M | 0.40 | 1.0 | 17.2 | 11.3 |
| N | 1.00 | 1.5 | 17.4 | 9.9 |
| O | 0.80 | 1.5 | 27.5 | 22.5 |
| P | 1.40 | 2.0 | 22.2 | 10.4 |
| Q | 1.60 | 2.0 | 23.6 | 15.2 |
| R | 1.60 | 2.5 | 25.5 | 11.1 |
| S | 1.80 | 2.5 | 26.5 | 14.5 |
| T | 1.80 | 3.0 | 26.5 | 9.7 |
| U | 1.80 | 3.0 | 25.5 | 10.7 |

Moreover, the shaping treatment is performed by the following method. That is, the coal, iron ore and binder are mixed so that blending ratios are set to 65.8 mass %, 28.2 mass % and 6 mass % to the total weight of raw materials, respectively. As to the coal, the easily softening coal and the hardly softening coal are blended. A mixture of these raw materials is kneaded in a high-speed mixer at 140-160° C. for about 2 minutes, and the kneaded material is shaped into briquettes in a double roll type shaping machine. A size of the roll is 650 mm in diameter and 104 mm in width, and shaping is performed at a peripheral speed of 0.2 m/s and a linear pressure of 4 t/cm. A shaped body has a size of 30 mm×25 mm×18 mm (6 cc) and is oval.

Then, the thus obtained shaped bodies are carbonized according to the following carbonization process of a laboratory scale. That is, 3 kg of the shaped bodies are filled in a carbonization can of 300 mm in both length and 400 mm in height, kept at a furnace wall temperature of 1000° C. for 6 hours and then cooled in nitrogen atmosphere. The carbonized material cooled to room temperature is taken out to measure strength and evaluate a fusion ratio. The measurement of the strength is performed as a drum strength ($DI^{150}{}_{6}$) In this regard, $DI^{150}{}_{6}$ means a value obtained by measuring a mass ratio of coke having a grain size of not less than 6 mm under a condition of 15 rpm, 150 revolutions by a revolution strength testing method of JIS K2151. A target strength is set to not less than 82. The fusion ratio is evaluated by a weight percentage of a fused material to a total weight of the carbonized material.

Example 1: Preferable CSN and Volatile Matter of Hardly Softening Coal and Nature of Easily Softening Coal in a Coal Blend As to the results of the above experiment, ferrocoke strength to a value obtained by multiplying CSN of the easily softening coal by a weight ratio of the easily softening coal to the total coal weight is plotted in a graph of FIG. 1. As the hardly softening coal is used a coal having CSN of 1.0 and a volatile matter of 13.6% and 17.2%. Table 2 describes two kinds of coals having CSN of 1.0 as brands J and K of the hardly softening coal. In the case that the volatile matter is 13.6%, the brands J and K are blended in an each amount of 50 mass %, while in the case that the volatile matter is 17.2%, brands L and M are blended in an each amount of 50 mass %.

Table 3 shows a blending condition of the easily softening coal blended with the hardly softening coal, value obtained by multiplying CSN of the easily softening coal by a weight ratio of the easily softening coal to the total coal weight, and strength of ferrocoke obtained from a mixed coal blended with a coal having CSN of 1.0 as the hardly softening coal as data in the graph of FIG. 1. Even when any easily softening coal is used, if the hardly softening coal has CSN of 1.0 and a volatile matter of 13.6%, it can be seen that the strength after the carbonization largely falls below the target strength different from that of the examples described in the above patent documents. Since ferrocoke contains an iron ore having no compatibility with carbon materials, it is considered that the ferrocoke strength is apt to be largely decreased when being blended with a hardly softening coal hardly fused by softening and showing no swellability.

In FIG. 1, the plot having 0 as the value of abscissa axis shows the result in the blending of only hardly softening coals. When the volatile matter is 13.6%, the strength is largely decreased. On the other hand, when the volatile matter is 17.2%, the strength is near to the target value in the blending of only the coals. In the case that the blending ratio of the easily softening coal is 0.1-0.8, the strength exceeds the target value when the value obtained by multiplying CSN of the easily softening coal by the blending weight ratio of the easily softening coal is 0.3-5.2. Even when the volatile matter is 17.2%, it is considered that the swellability is low at CSN of 1.0, but since the coal is at a state of somewhat promoting carbonization as compared to strong caking coal, mitigation of carbon structure associated with heating is easily caused as compared to the case that the volatile matter is 13.6%. To this end, it is guessed that the coal is slightly softened under carbonization condition through rapid heating as in this experiment (rapid heating condition even in the actual shaft furnace) and hence the strength is recognized to be in a range exceeding the target value. Moreover, the reason why the optimum range is existent in the value obtained by multiplying CSN of the easily softening coal by the blending weight ratio of the easily softening coal is considered due to the fact that when the value is small, swelling of the coal is small and the adhesion between the grains is deteriorated, while when the value is large, the strength after the carbonization is decreased by increase of porosity associated with the swelling of the carbonized material.

TABLE 3

| Blending condition of easily softening coal | | | | | |
|---|---|---|---|---|---|
| Brand used | CSN | Blending ratio | CSN*Blending ratio | $DI^{150}_{6}$ (-) VM 13.6% | $DI^{150}_{6}$ (-) VM 17.2% |
| — | — | 0 | 0 | 16.0 | 76.0 |
| A | 2.5 | 0.05 | 0.13 | 18.0 | 77.0 |
| B | 3.0 | 0.1 | 0.30 | 25.1 | 82.0 |
| C | 3.5 | 0.2 | 0.70 | 38.0 | 82.0 |
| D | 4.5 | 0.3 | 1.35 | 43.2 | 82.6 |
| D | 4.5 | 0.6 | 2.70 | 60.0 | 83.2 |
| E | 5.0 | 0.6 | 3.00 | 58.0 | 84.0 |
| F | 5.5 | 0.8 | 4.40 | 64.0 | 83.5 |
| G | 6.0 | 0.6 | 3.60 | 68.0 | 84.5 |
| H | 6.5 | 0.8 | 5.20 | 71.0 | 83.0 |
| I | 7.0 | 0.8 | 5.60 | 69.0 | 80.0 |

Example 2: Preferable CSN of Hardly Softening Coal and Nature of Easily Softening Coal in a Coal Blend Hardly softening coals having CSN of 1.5 and 2.0 are examined below. That is, the examination is performed by blending coals N and O having CSN of 1.5 and coals P and Q having CSN of 2.0 as shown in Table 2 in an each amount of 50 mass %. Table 4 shows a blending condition of an easily softening coal blended with the hardly softening coal, value obtained by multiplying CSN of the easily softening coal by a weight ratio of the easily softening coal to the total coal weight, and strength of ferrocoke obtained from a coal blend combined with the hardly softening coal having CSN of 1.5 and 2.0 as the examination results. Based on the results of Table 4 are plotted ferrocoke strengths to the value obtained by multiplying CSN of the easily softening coal by the weight ratio of the easily softening coal to the total coal weight in the graph of FIG. 2.

TABLE 4

| Blending conditions of easily softening coal | | | | $DI^{150}_{6}$ (-) Hardly softening coal CSN:1.5 | $DI^{150}_{6}$ (-) Hardly softening coal CSN:2.0 |
|---|---|---|---|---|---|
| Brand used | CSN | Blending ratio | CSN*Blending ratio | | |
| — | — | 0 | 0 | 82.0 | 82.0 |
| A | 2.5 | 0.1 | 0.25 | 82.1 | 82.4 |
| A | 2.5 | 0.2 | 0.50 | 82.1 | 82.0 |
| B | 3.0 | 0.2 | 0.60 | 82.3 | 83.3 |
| C | 3.5 | 0.8 | 2.80 | 84.1 | 84.3 |
| D | 4.5 | 0.4 | 1.80 | 83.8 | 83.0 |
| D | 4.5 | 0.8 | 3.60 | 85.6 | 85.0 |
| E | 5.0 | 0.4 | 2.00 | 82.4 | 82.0 |
| E | 5.0 | 0.8 | 4.00 | 84.5 | 85.5 |
| F | 5.5 | 0.6 | 3.30 | 84.5 | 85.8 |
| F | 5.5 | 0.8 | 4.40 | 84.6 | 84.1 |
| G | 6.0 | 0.6 | 3.60 | 84.0 | 84.1 |
| G | 6.0 | 0.8 | 4.80 | 83.3 | 82.2 |
| H | 6.5 | 0.2 | 1.30 | 82.5 | 83.0 |
| H | 6.5 | 0.8 | 5.20 | 81.7 | 81.8 |
| I | 7.0 | 0.4 | 2.80 | 84.6 | 84.0 |
| I | 7.0 | 0.6 | 4.20 | 83.1 | 84.0 |

Figure 2:
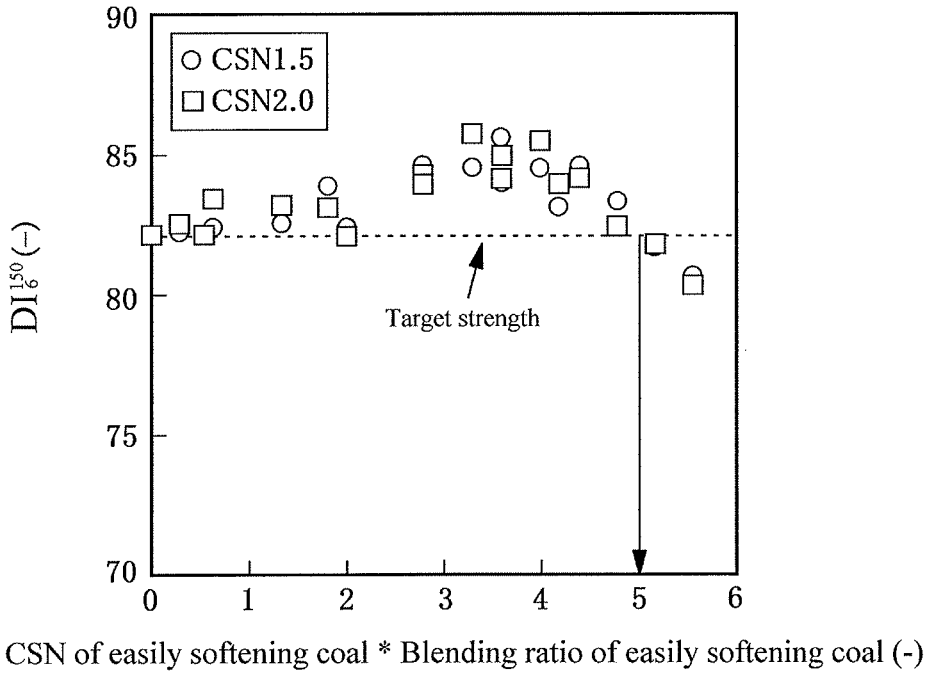
FIG. 2 is a graph showing a relation between CSN of an easily softening coal and a blending ratio of an easily softening coal exerting a strength after carbonization in the case of using a hardly softening coal with a button index (CSN) of 1.5 and 2.0.

As seen from the results shown in Table 4 and FIG. 2, when the blending ratio of the easily softening coal is not more than 0.8, the strengths higher than that in the case that CSN of the hardly softening coal shown in FIG. 1 is 1.0 are obtained even in any values obtained by multiplying CSN of the easily softening coal by the blending weight ratio of the easily softening coal. Also, it can be seen that the strength is made to not less than the target value when the value obtained by multiplying CSN of the easily softening coal by the blending weight ratio of the easily softening coal is not more than 5.0. Moreover, the reason why the optimum range is existent in the value obtained by multiplying CSN of the easily softening coal by the blending weight ratio of the easily softening coal is considered due to the fact that if the value is larger, the strength after the carbonization is decreased due to the increase of the porosity associated with the swelling of the carbonized material.

Example 3: Preferable CSN of Hardly Softening Coal in a Coal Blend

Figure 3:
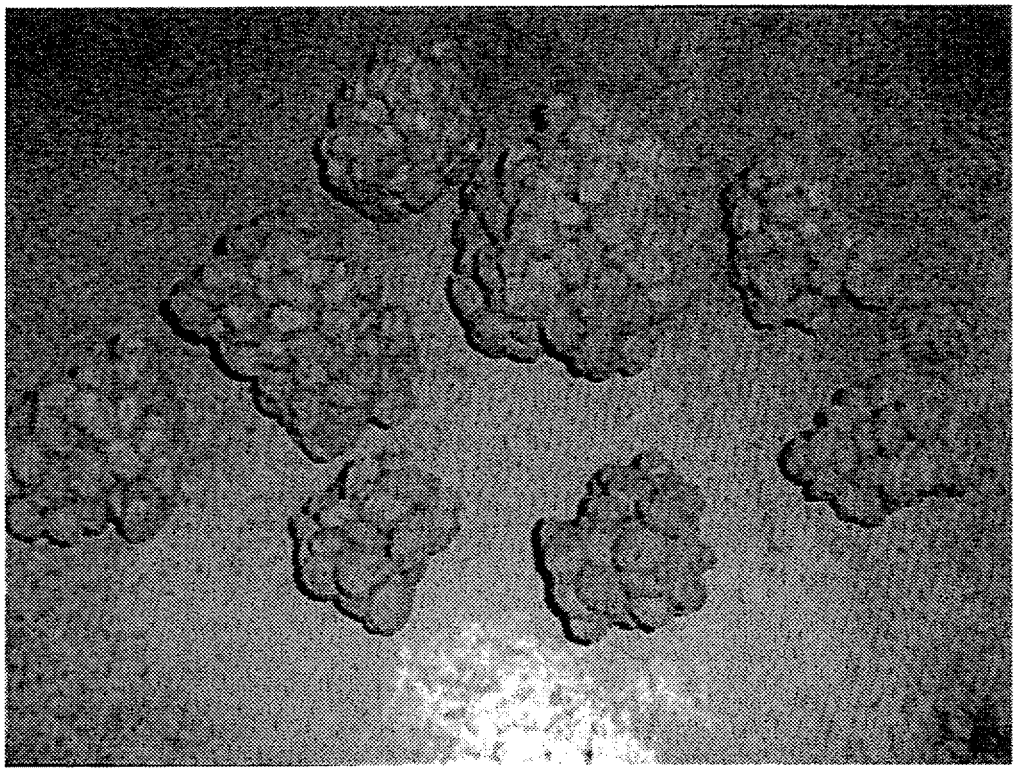
FIG. 3 is a photograph showing an appearance of fused ferrocoke.
Figure 4:
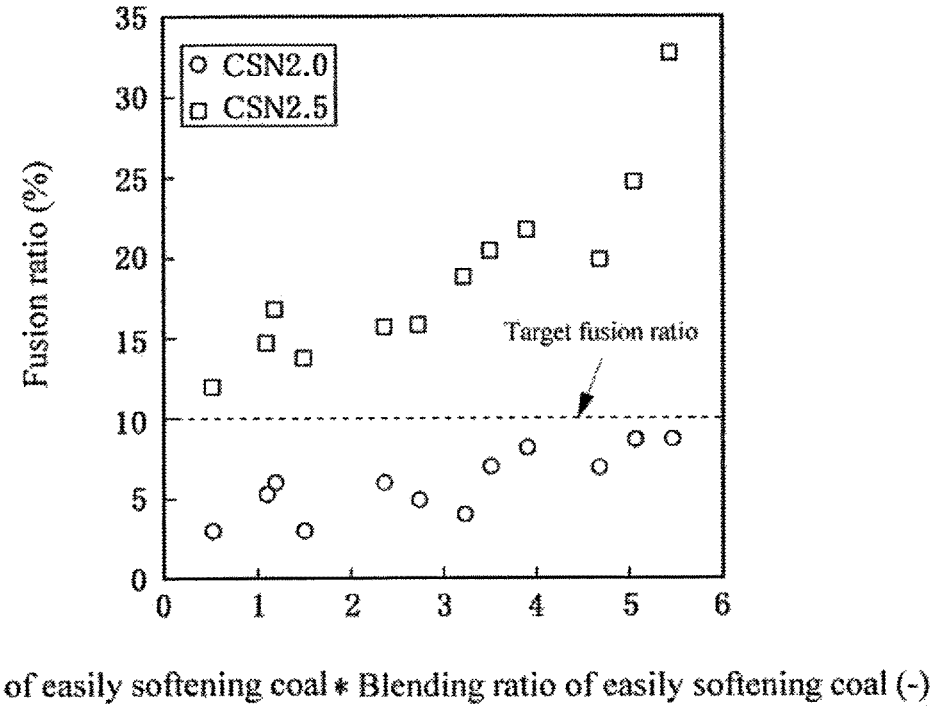
FIG. 4 is a diagram showing an influence of CSN of a hardly softening coal upon a fusion ratio.

A fear of fusing the carbonized material is caused in the case that CSN of the hardly softening coal is 2.5. In FIG. 3 is shown a photograph of a fused case. Table 5 and FIG. 4 show results of fusion test when two kinds of hardly softening coals having CSN of 2.0 and 2.5 are carbonized in a laboratory scale to the value obtained by multiplying CSN of the easily softening coal by a blending weight ratio of the easily softening coal. In Table 2 are shown two kinds of coals having CSN of 2.5 as hardly softening coals P and Q. In this test, these coals are blended in an each amount of 50 mass %. As seen from the results of FIG. 4, the fusion ratio is not more than 10% when CSN of the hardly softening coal is 2.0. On the other hand, when CSN of the hardly softening coal is 2.5, the fusion ratio is not less than about 20%. Moreover, the term "fusion ratio" means a mass ratio of fused ferrocoke as shown in FIG. 3 in mass of ferrocoke produced.

TABLE 5

| Blending conditions of easily softening coal | | | | Fusion ratio (%) Hardly softening coal CSN:2.0 | Fusion ratio (%) Hardly softening coal CSN:2.5 |
|---|---|---|---|---|---|
| Brand used | CSN | Blending ratio | CSN*Blending ratio | | |
| A | 2.5 | 0.2 | 0.5 | 3.0 | 12.0 |
| A | 2.5 | 0.6 | 1.5 | 3.0 | 14.0 |
| B | 3.0 | 0.8 | 2.4 | 6.1 | 15.8 |
| D | 4.5 | 0.8 | 3.6 | 7.1 | 20.5 |
| E | 5.0 | 0.8 | 4.0 | 8.2 | 22.0 |
| F | 5.5 | 0.2 | 1.1 | 5.3 | 15.0 |
| F | 5.5 | 0.6 | 3.3 | 4.0 | 19.0 |
| G | 6.0 | 0.2 | 1.2 | 6.1 | 17.0 |
| G | 6.0 | 0.8 | 4.8 | 7.0 | 20.0 |
| H | 6.5 | 0.8 | 5.2 | 8.7 | 25.0 |
| I | 7.0 | 0.4 | 2.8 | 5.0 | 16.0 |
| I | 7.0 | 0.8 | 5.6 | 8.8 | 33.0 |

In this carbonization test, the shaped bodies are carbonized at a fixed state (fixed layer). In the case of a continuous production, it is a continuous system wherein the shaped bodies are charged from a top of a furnace such as shaft type furnace and the carbonized material is continuously discharged from a bottom of the furnace. It is commonly considered that the fusion is apt to be caused in the carbonization at the fixed layer as compared to the continuous system. Then, the inventors have made a test in a carbonization furnace of a laboratory scale on the shaped bodies causing poor discharge associated with fusion inside the furnace in the continuous shaft type carbonization bench plant in order to evaluate the difference of fusion ratios between the carbonization in the fixed layer and the continuous carbonization. In this carbonization test, the shaped bodies showing the fusion ratio of not less than 10% cause the poor discharge associated with the fusion inside the furnace in the continuous carbonization furnace. The dotted line in FIG. 4 shows a lower limit of the fusion ratio causing the poor discharge in the continuous carbonization furnace. When CSN of the hardly softening coal is 2.5, a fear of fusion becomes large in the continuous carbonization, so that the upper limit of CSN in the hardly softening coal is revealed to be 2.0.

Example 4: Other Preferable Cases

In this example, coal, iron ore and binder are mixed so as to render each blending ratio into 65.8 mass %, 28.2 mass % and 6 mass % to the total weight of these raw materials, respectively. A coal A in Table 1 is used as an easily softening coal and a coal O in Table 2 is used as a hardly softening coal. A blending ratio of the easily softening coal to the hardly softening coal is 1/9 and 7/3. Thus, a value obtained by multiplying CSN of the easily softening coal by a weight ratio of the easily softening coal to the total coal weight is 0.25, which is obtained by multiplying CSN of 2.5 of the coal A by the blending ratio of 0.1 of the easily softening coal in the case of 1/9. In the case of 7/3, the value is 1.75, which is obtained by multiplying CSN of 2.5 of the coal A by the blending ratio of 0.7 of the easily softening coal.

Figure 5:
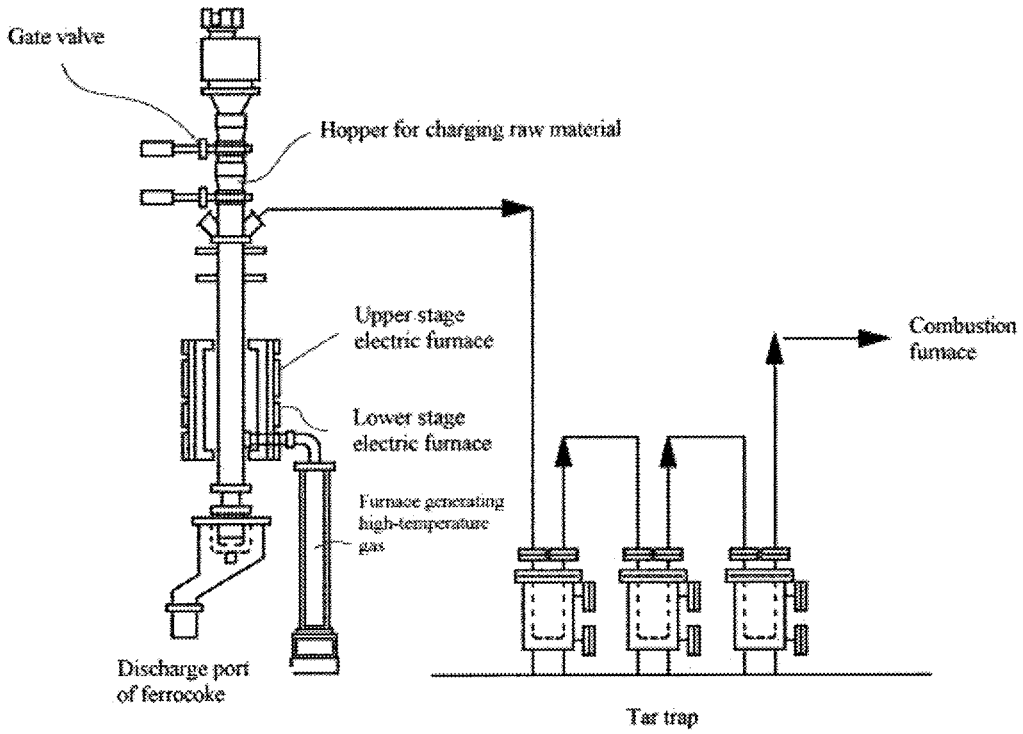
FIG. 5 is a schematic view of a shaft type carbonization furnace.
Figure 6:
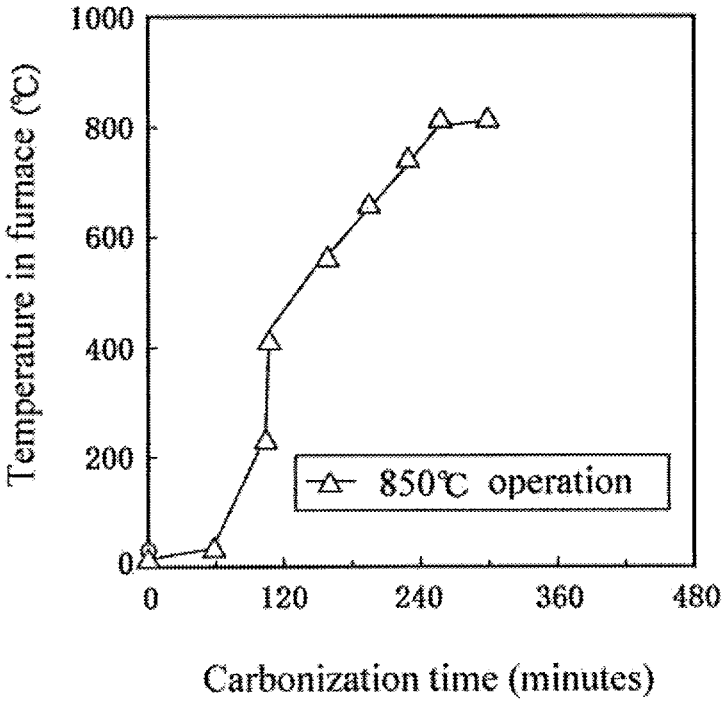
FIG. 6 is a graph showing a heat pattern inside a shaft type carbonization furnace.

In the carbonization test is used a shaft type carbonization furnace of 0.3 t/d shown in FIG. 5. It is a continuous countercurrent type furnace made of SUS and having a size of 0.25 m in diameter×3 m in height and provided with a cooling equipment for generated gas. Thermocouples are disposed at an interval of about 10-20 cm in a center of a reaction tube from the top of the furnace toward a cooling zone at a bottom of the furnace to determine heating conditions for a predetermined heat pattern. In this example, an upper stage electric furnace is set to 700° C. and a lower stage electric furnace is set to 850° C., and further a high-temperature gas of 850° C. is passed from the bottom of the furnace at a flow rate of 60 L/min. FIG. 6 shows a heat pattern when the temperature in the lower stage electric furnace and the high temperature gas is set to 850° C. A highest achieving temperature in the center of the reaction tube is 852° C., and a time keeping this temperature is about 60 minutes. Green briquettes are charged into the inside of the furnace from the top of the furnace through a double valve, while carbonized ferrocoke is continuously discharged from the bottom of the furnace. Ferrocoke discharged at an interval of 30 minutes is taken out to measure a strength. The results are shown in FIG. 7.

Figure 7:
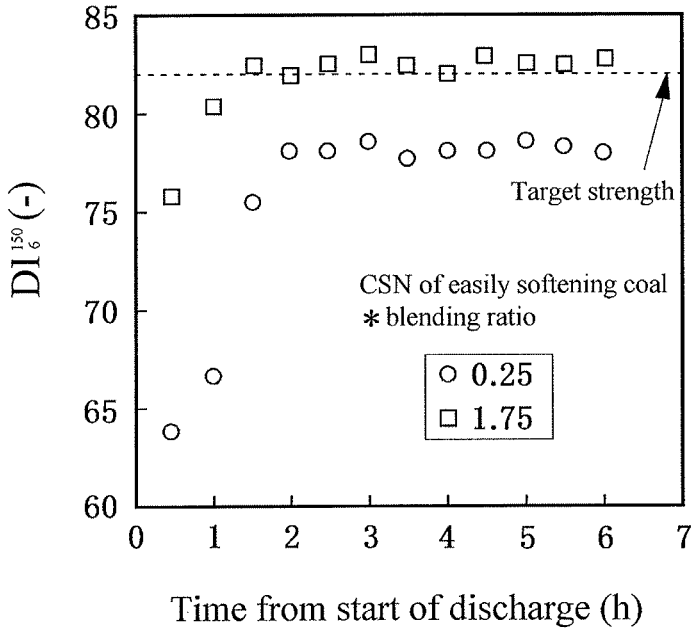
FIG. 7 is a graph showing a change of ferrocoke strength with lapse of time.

The followings are understood from the results of FIG. 7. Firstly, a carbonized material is discharged from the start of ferrocoke discharge up to 2 hours under a condition that a carbonization temperature of a shaped body is not sufficient, so that the ferrocoke strength is low. However, the discharge of ferrocoke becomes steady at a time exceeding 2 hours from the start of the discharge. In the case that CSN*blending ratio of easily softening coal is 1.75, the target strength is stably held at a time exceeding 2 hours from the start of the discharge. In the case that CSN*blending ratio of easily softening coal is 0.25, the strength becomes constant at a state of falling down the target value.

From the above is understood that the preferable conditions of hardly softening coal and easily softening coal for manufacturing a high-strength ferrocoke are as follows.

In order to manufacture a high-strength ferrocoke, it is important on the premise of using a blend of easily softening coal and hardly softening coal that a coal having a button index (CSN) of 1.0 and a volatile matter of not less than 17.0% or a button index (CSN) of 1.5-2.0 is used as the hardly softening coal and the easily softening coal satisfies that a value obtained by multiplying CSN of the easily softening coal by a blending ratio thereof to the total coal is within a range of 0.3-5.2.

Also, in order to manufacture a high-strength ferrocoke, it is important on the premise of using a blend of easily softening coal and hardly softening coal that a coal having a button index (CSN) of 1.5-2.0 is used as the hardly softening coal and the easily softening coal satisfies that a value obtained by multiplying CSN of the easily softening coal by a blending ratio thereof to total coal weight is not more than 5.0.

According to the ferrocoke manufacturing method according to the invention can be manufactured ferrocoke having a high strength and being low in cost and high in the reactivity, and it is possible to operate a blast furnace at a low reducing material ratio by using the thus obtained ferrocoke as a coal material.

The invention claimed is:

1. A ferrocoke manufacturing method comprising:

(i) mixing a mixture of coal and iron ore, (ii) shaping the mixture into a shaped body, and (iii) carbonizing the shaped body, wherein the coal is a blend of a hardly softening coal and an easily softening coal, and the hardly softening coal has a button index (CSN) of 1.0 and a volatile matter of not less than 17%, and the easily softening coal satisfies a value obtained by multiplying CSN of the easily softening coal by a blending ratio thereof in all coals that is a range of 0.3-5.2, wherein the hardly softening coal has a maximum fluidity of less than 2 ddpm measured by Gieseler plastometer as described in Japanese Industrial Standard (JIS) M8801.

2. The ferrocoke manufacturing method according to claim 1, wherein the blending ratio of the easily softening coal in all coals is not more than 0.8.

3. A ferrocoke manufacturing method comprising:

(i) mixing a mixture of coal and iron ore, (ii) shaping the mixture into a shaped body, and (iii) carbonizing the shaped body, wherein the coal is a blend of the hardly softening coal and the easily softening coal, and the hardly softening coal is a coal having a button index (CSN) of 1.5-2.0 and a volatile matter of not less than 17%, and the easily softening coal satisfies a value obtained by multiplying CSN of the easily softening coal by a blending ratio thereof in all coals that is not more than 5.0, wherein the hardly softening coal has a maximum fluidity of less than 2 ddpm measured by Gieseler plastometer as described in Japanese Industrial Standard (JIS) M8801.

4. The ferrocoke manufacturing method according to claim 1, wherein the hardly softening coal has a volatile matter of not less than 22.2%.

5. The ferrocoke manufacturing method according to claim 1, wherein the hardly softening coal is a coal having a volatile matter of not more than 26.5.

* * * * *